US009310105B2

(12) United States Patent
Lee et al.

(10) Patent No.: US 9,310,105 B2
(45) Date of Patent: Apr. 12, 2016

(54) REFRIGERATOR AND CONTROLLING METHOD OF THE SAME

(75) Inventors: Hoyoun Lee, Seoul (KR); Sung Jhee, Seoul (KR); Sunam Chae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1034 days.

(21) Appl. No.: 13/193,222

(22) Filed: Jul. 28, 2011

(65) Prior Publication Data

US 2012/0023980 A1 Feb. 2, 2012

(30) Foreign Application Priority Data

Jul. 29, 2010 (KR) ..... 10-2010-0073648

(51) Int. Cl.

| | |
|---|---|
| ***F25D 29/00*** | (2006.01) |
| ***F25B 1/10*** | (2006.01) |
| ***F25B 5/02*** | (2006.01) |
| ***F25B 49/02*** | (2006.01) |

(52) U.S. Cl.

CPC ... *F25B 1/10* (2013.01); *F25B 5/02* (2013.01); *F25B 49/022* (2013.01); *F25D 29/00* (2013.01); *F25B 2700/2104* (2013.01); *F25D 2700/121* (2013.01); *F25D 2700/122* (2013.01); *F25D 2700/123* (2013.01)

(58) Field of Classification Search

CPC ... F25D 11/02; F25D 11/022; F25D 2600/02; F25D 2700/122; F25B 1/10

USPC ..... 62/199, 196.2, 196.1, 228.5

See application file for complete search history.

(56) References Cited

U.S. PATENT DOCUMENTS

| | | | | |
|---|---|---|---|---|
| 6,370,895 | B1 * | 4/2002 | Sakuma et al. | 62/199 |
| 8,869,546 | B2 * | 10/2014 | Besore et al. | 62/157 |
| 2002/0035841 | A1 * | 3/2002 | Flynn | 62/217 |
| 2002/0069654 | A1 * | 6/2002 | Doi et al. | 62/199 |
| 2005/0210898 | A1 * | 9/2005 | Bae et al. | 62/197 |
| 2007/0130635 | A1 * | 6/2007 | Sarreal et al. | 800/278 |
| 2009/0105884 | A1 * | 4/2009 | Kaga et al. | 700/275 |
| 2012/0312034 | A1 * | 12/2012 | Oh et al. | 62/84 |
| 2013/0192294 | A1 * | 8/2013 | Yoo et al. | 62/510 |

* cited by examiner

*Primary Examiner* — Ljiljana Ciric
*Assistant Examiner* — Alexis Cox
(74) *Attorney, Agent, or Firm* — Birch, Stewart, Kolasch & Birch, LLP

(57) ABSTRACT

The temperatures in a refrigerating chamber and freezing chamber are monitored with sensors. An amount of change in a refrigerating chamber temperature, or an amount of change of a freezing chamber temperature is calculated per time period. A load corresponding driving is executed if the amount of change in a current time period differs from an amount of change in a previous time period.

5 Claims, 5 Drawing Sheets

REFRIGERATOR AND CONTROLLING METHOD OF THE SAME

CROSS-REFERENCE TO RELATED APPLICATION

Pursuant to 35 U.S.C. §119(a), this application claims the benefit of earlier filing date and right of priority to Korean Application No. 10-2010-0073648, filed on Jul. 29, 2010, the contents of which is incorporated by reference herein in its entirety.

BACKGROUND OF THE INVENTION

1. Field of the Invention

The present invention relates to a refrigerator, and more particularly, to a refrigerator which constitutes a refrigerating cycle by a plurality of compressors and evaporators.

2. Description of the Background Art

Generally, a refrigerator serves to store items to be stores such as food and beverages for a long time with a fresh state. This refrigerator stores items with a cool or frozen state according to a type of the items.

The refrigerator is driven by driving a compressor provided therein. Cool air supplied into the refrigerator is generated through heat exchange with a refrigerant. The cool air is continuously supplied into the refrigerator via a refrigerating cycle such as compression, condensation, expansion and evaporation. The refrigerant supplied into the refrigerator is evenly distributed by convection, thereby allowing food inside the refrigerator to be stored at a desired temperature. The cycle is variable according to a configuration of a refrigerating cycle apparatus inside the refrigerator.

Generally, the refrigerator performs a load corresponding driving in correspondence to a changed load. In the conventional refrigerator and method for controlling the same, a load corresponding driving is performed by opening and closing a refrigerating chamber door or a freezing chamber door, upon detection of temperature increment inside the refrigerator. This may cause a difficulty in checking a precise time point when performing a load corresponding driving, according to a position, a performance, etc. of a temperature sensor.

SUMMARY OF THE INVENTION

An object of the present invention is to provide a refrigerator capable of performing a load corresponding driving based on a change amount of a refrigerating chamber temperature calculated per predetermined time period, and a method for controlling the same.

Another object of the present invention is to provide a refrigerator capable of performing a load corresponding driving based on a change amount of a freezing chamber temperature calculated per predetermined time period, and a method for controlling the same.

To achieve these and other advantages and in accordance with the purpose of this specification, as embodied and broadly described herein, there is provided a refrigerator, comprising: one or more refrigerating chamber temperature sensors configured to sense a refrigerating chamber temperature of a refrigerator; and a controller configured to perform a general driving for maintaining the refrigerating chamber temperature as a constant temperature, or to perform a load corresponding driving based on a change amount of the refrigerating chamber temperature calculated per predetermined time period.

According to one embodiment of the present invention, there is provided a refrigerator, comprising: one or more freezing chamber temperature sensors configured to sense a freezing chamber temperature; and a controller configured to perform a general driving for maintaining the freezing chamber temperature as a constant temperature, or to perform a load corresponding driving based on a change amount of the freezing chamber temperature calculated per predetermined time period.

The refrigerator may further comprise a first compressor connected to each other, and configured to compress a refrigerant with two-stage; a second compressor; a condenser connected to a discharge side of the second compressor disposed at a downstream side with respect to a flowing direction of the refrigerant; a first evaporator diverged from the condenser, and connected to a suction side of the first compressor disposed at an upstream side with respect to the flowing direction of the refrigerant; a second evaporator diverged from the condenser together with the first evaporator, and connected between a discharge side of the first compressor and a suction side of the second compressor; and a refrigerant switching valve installed at an outlet of the condenser on a divergence point of the first evaporator and the second evaporator, and configured to control the flowing direction of the refrigerant.

The controller may comprise a first calculator configured to calculate a change amount of the refrigerating chamber temperature per time period. And, the controller may comprise a second calculator configured to calculate a change amount of the freezing chamber temperature per time period.

The refrigerator may further comprise a storage unit configured to store either the change amount of the refrigerating chamber temperature or the change amount of the freezing chamber temperature, or to store both the change amount of the refrigerating chamber temperature and the change amount of the freezing chamber temperature.

The controller may maintain a current cooling capacity of the compressor when the change amount of the refrigerating chamber temperature or the change amount of the freezing chamber temperature is more than a reference value at the time of an initial driving. And, the controller may increase the cooling capacity of the compressor when the change amount of the refrigerating chamber temperature or the change amount of the freezing chamber temperature is less than the reference value at the time of an initial driving.

The controller may compare a change amount of the refrigerating chamber temperature calculated in the current time period with that in the previous time period, or compare a change amount of the freezing chamber temperature calculated in the current time period with that in the previous time period. If the change amount has been increased as a result of the comparison, the controller may perform a load corresponding driving.

If an increase degree of the change amount is greater than a first reference value, the controller may increase the cooling capacity of the compressor. If the increase degree of the change amount is smaller than the first reference value but larger than a second reference value, the controller may maintain the current cooling capacity of the compressor. If the increase degree of the change amount is smaller than the second reference value, the controller may decrease the cooling capacity of the compressor. For purposes of this disclosure, increasing and decreasing the cooling capacity of the compressor refers to changing the operation of the compressor to increase or decrease the amount of heat transferred.

To achieve these and other advantages and in accordance with the purpose of this specification, as embodied and broadly described herein, there is also provided a method for controlling a refrigerator, the method comprising: an initial driving step of changing a cooling capacity of a compressor based on a change amount of a refrigerating chamber temperature or a change amount of a freezing chamber temperature after an initial driving; a change amount calculation step of calculating the change amount of the refrigerating chamber temperature or the change amount of the freezing chamber temperature calculated per time period; and a driving execution step of executing a load corresponding driving based on the change amount of the refrigerating chamber temperature, or the change amount of the freezing chamber temperature calculated per time period.

In the initial driving step, when the change amount of the refrigerating chamber temperature or the change amount of the freezing chamber temperature is more than a reference value, a current cooling capacity of the compressor may be maintained. On the other hand, when the change amount of the refrigerating chamber temperature or the change amount of the freezing chamber temperature is less than the reference value, the cooling capacity of the compressor may be increased.

The driving execution step may comprise comparing a change amount of the refrigerating chamber temperature or the freezing chamber temperature calculated in the current time period with that in the previous time period, and executing a load corresponding driving when the change amount has been increased as a result of the comparison. In the step of executing a load corresponding driving, if an increase degree of the change amount is greater than a first reference value, the cooling capacity of the compressor may be increased. If the increase degree of the change amount is smaller than the first reference value but larger than a second reference value, the current cooling capacity of the compressor may be maintained. If the increase degree of the change amount is smaller than the second reference value, the cooling capacity of the compressor may be decreased.

In the present invention, a change amount of the refrigerating chamber temperature may be calculated per time period, and a load corresponding driving may be executed based on the calculated change amount. This may allow the load corresponding driving to be executed more precisely, reduce power consumption, and enhance stability and efficiency of the system.

In the present invention, a change amount of the freezing chamber temperature may be calculated per time period, and a load corresponding driving may be executed based on the calculated change amount. This may allow the load corresponding driving to be executed more precisely, reduce power consumption, and enhance stability and efficiency of the system.

DETAILED DESCRIPTION OF THE INVENTION

Figure 1:
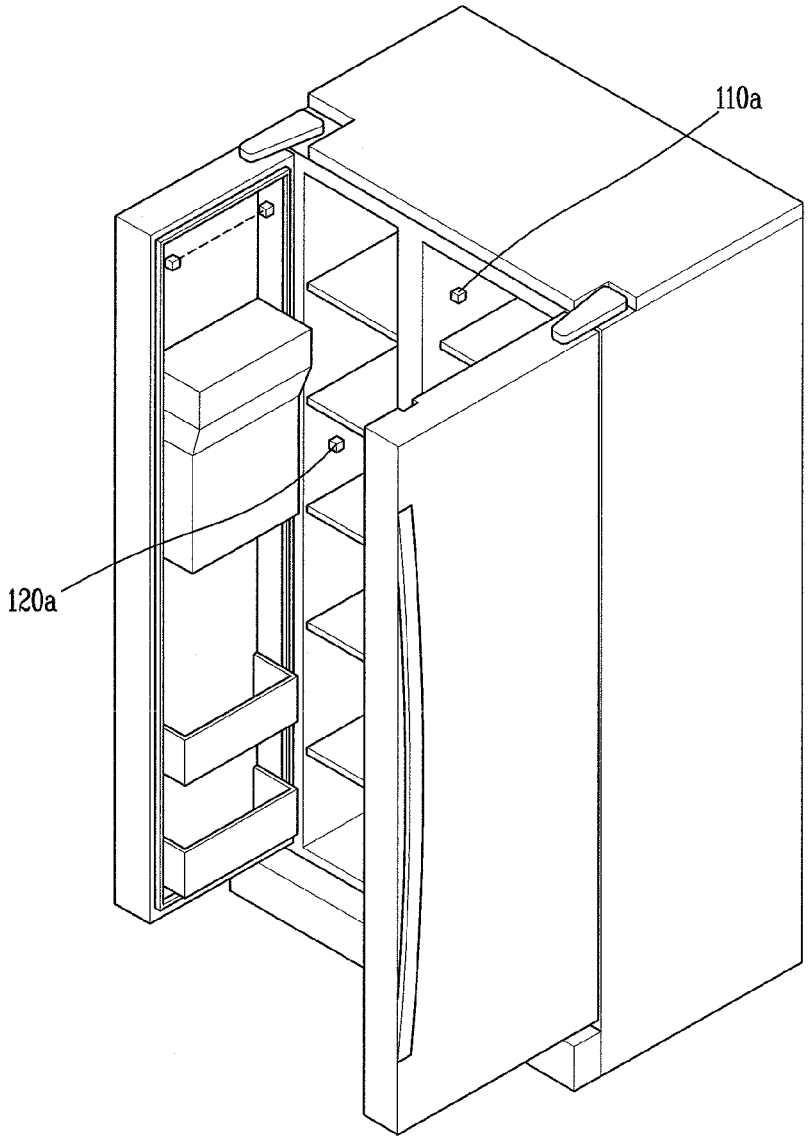
FIG. 1 is a perspective view illustrating the appearance of a refrigerator in accordance with the conventional art.

Referring to FIG. 1, the conventional refrigerator comprises a refrigerator body having a freezing chamber and a refrigerating chamber, and a freezing chamber door and a refrigerating chamber door configured to open and close the freezing chamber and the refrigerating chamber, respectively.

Figure 3:
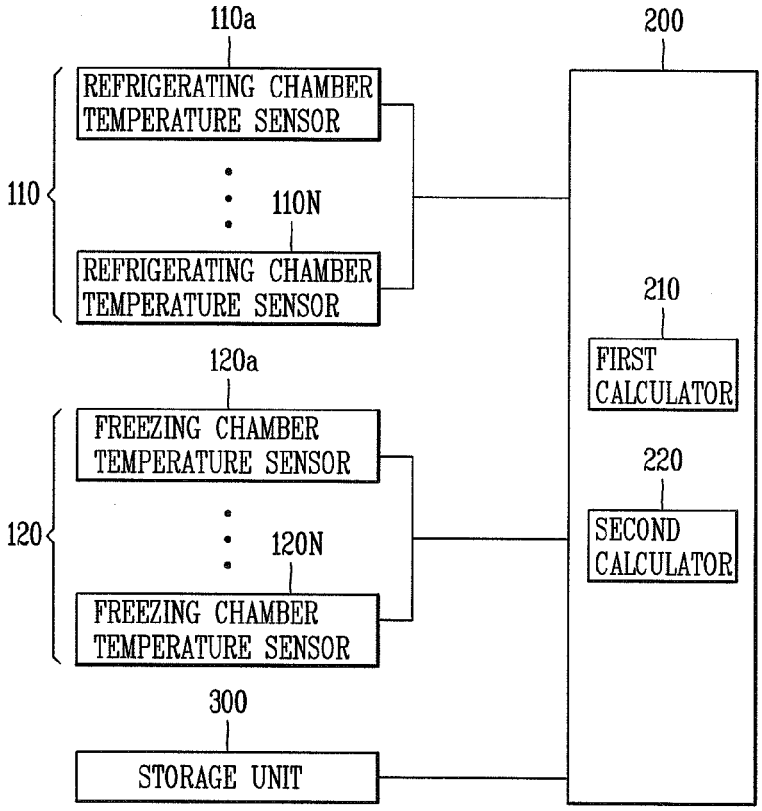
FIGS. 3 and 4 are block diagrams schematically illustrating a configuration of a refrigerator according to preferred embodiments of the present invention.

Referring to FIG. 3, a refrigerator according to a first embodiment of the present invention comprises one or more refrigerating chamber temperature sensors 110, 110*a* . . . 110N configured to sense a refrigerating chamber temperature, and a controller 200 configured to perform a general driving for maintaining the refrigerating chamber temperature as a constant temperature, or to perform a load corresponding driving based on a change amount of the refrigerating chamber temperature calculated per predetermined time period. The refrigerator further comprises one or more freezing chamber temperature sensors 120 configured to sense a freezing chamber temperature.

Referring back to FIG. 3, the refrigerator according to a first embodiment of the present invention comprises one or more freezing chamber temperature sensors 120, 120*a* . . . 120N configured to sense a freezing chamber temperature, and a controller 200 configured to perform a general driving for maintaining the freezing chamber temperature as a constant temperature, or to perform a load corresponding driving based on a change amount of the freezing chamber temperature calculated per predetermined time period. The refrigerator further comprises one or more refrigerating chamber temperature sensors 110 configured to sense a refrigerating chamber temperature.

Differently from the general driving, the load corresponding driving indicates a driving to allow the refrigerator to be in a normal driving state by increasing or decreasing a cooling capacity according to a load change.

The controller 200 includes a first calculator 210 configured to calculate a change amount of the refrigerating chamber temperature per time period. And, the controller 200 further includes a second calculator 220 configured to calculate a change amount of the freezing chamber temperature per time period.

The refrigerator further comprises a storage unit 300 configured to store either the change amount of the refrigerating chamber temperature or the change amount of the freezing chamber temperature, or to store both of the change amount of the refrigerating chamber temperature and the change amount of the freezing chamber temperature.

Figure 2:
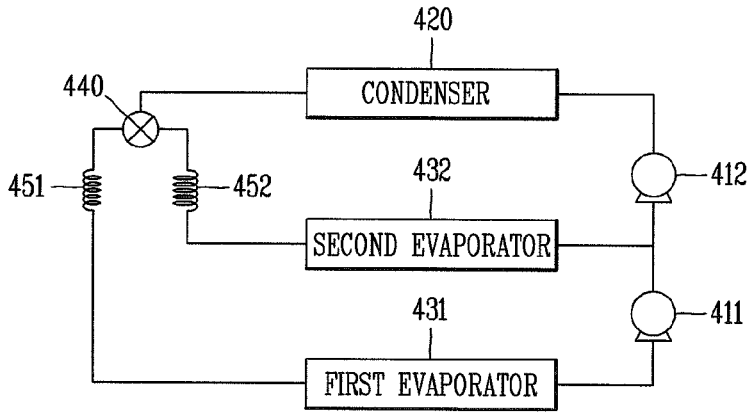
FIG. 2 is a block diagram schematically illustrating a refrigerating cycle apparatus according to preferred embodiment of the present invention.

Referring to FIG. 2, the refrigerator further comprises a refrigerating cycle apparatus consisting of a first compressor 411, a second compressor 412, a condenser 420, a first evaporator 431, a second evaporator 432 and a refrigerant switching valve 440. The first compressor 411 and the second compressor 412 are connected to each other so as to compress a refrigerant with two-stage. The condenser 420 is connected to a discharge side of the second compressor disposed at a downstream side with respect to a flowing direction of the refrigerant. The first evaporator 431 is diverged from the condenser, and connected to a suction side of the first compressor disposed at an upstream side with respect to the flowing direction of the refrigerant. The second evaporator 432 is diverged from the condenser together with the first evaporator 431, and connected between a discharge side of the first compressor and a suction side of the second compressor. The refrigerant switching valve 440 is installed at an outlet of the condenser on a divergence point of the first evaporator and the second evaporator, and configured to control the flowing direction of the refrigerant. Here, the refrigerator may be provided with other refrigerating cycle apparatus if necessary.

A mechanical chamber is provided at a lower side of the refrigerator body. And, the first compressor 411, the second compressor 412 and the condenser 420 of a refrigerating cycle apparatus for generating cool air are installed at the mechanical chamber. The compressors 411 and 412 are arranged in series and in plurality in number. More concretely, a discharge side of the first compressor 411 is connected to a suction side of the second compressor 412 so that a refrigerant primarily-compressed at the first compressor 411 can be secondarily-compressed at the second compressor 412. A discharge side of the second compressor 412 is connected to an inlet of the condenser 420. The first compressor 411 and the second compressor 412 may be designed to have the same capacity. However, with consideration of a general refrigerator where a refrigerating chamber driving is more frequently performed than a freezing chamber driving, the second compressor 412 which performs a refrigerating chamber driving may be designed to have a capacity larger than that of the first compressor 411 by approximately two times.

The first and second evaporators 431 and 432 which constitute part of the refrigerating cycle apparatus are diverged to a first branch tube and a second branch tube at an outlet of the condenser 420. And, the first and second evaporators 431 and 432 are connected to each other in parallel. On the divergence point where the first branch tube and the second branch tube are diverged from each other, installed is the refrigerant switching valve 440 configured to control a flowing direction of a refrigerant. At intermediate parts of the first and second branch tubes, i.e., at inlets of the first and second evaporators 431 and 432 disposed at both sides, installed are a first expander 451 and a second expander 452 configured to expand a refrigerant.

The refrigerant switching valve 440 may be implemented s a three-way valve. For instance, the refrigerant switching valve 440 may be implemented so that an outlet of the condenser and one evaporator selected from the two evaporators can be communicated with each other, or so that the outlet of the condenser and the two evaporators can be communicated with each other.

The refrigerator having the refrigerating cycle apparatus of FIG. 2 has the following effects.

More concretely, the refrigerant switching valve 440 controls a flowing direction of a refrigerant to the first evaporator 431 or the second evaporator 432 according to a driving mode of the refrigerator. This may implement a simultaneous driving for driving the refrigerating chamber and the freezing chamber, or a freezing chamber driving for driving only the freezing chamber or a refrigerating chamber driving for driving only the refrigerating chamber.

For instance, when a driving mode of the refrigerator is a simultaneous driving, the refrigerant switching valve 440 is completely open so that a refrigerant passing through the condenser 420 can be moved in a distributed manner to the first evaporator 431 and the second evaporator 432. At the same time, both of the first compressor 411 and the second compressor 412 start to be driven.

The refrigerant sucked into the first compressor 411 via the first evaporator 431 is primarily-compressed at the first compressor 411 thus to be discharged. Then, the primarily-compressed refrigerant discharged from the first compressor 411 is sucked into the second compressor 412. Here, the refrigerant passing through the second evaporator 432 is mixed with the refrigerant discharged after being primarily-compressed at the first compressor 411, thereby being sucked into the second compressor 412.

Then, the primarily-compressed refrigerant and the refrigerant having passed through the second evaporator 432 are compressed in the second compressor 412 thus to be discharged. The refrigerant discharged from the second compressor 412 is moved to the condenser 420 thus to be condensed. And, the condensed refrigerant is distributed to the first evaporator 431 and the second evaporator 432 by the refrigerant switching valve 440. These processes are repeatedly performed.

On the other hand, when the driving mode of the refrigerator is a freezing chamber driving, the refrigerant switching valve 440 closes the second evaporator 432, i.e., a refrigerating chamber side evaporator, but opens the first evaporator 431, i.e., a freezing chamber side evaporator. This may allow the refrigerant passing through the condenser 420 to move only to the first evaporator 431. However, the first compressor 411 and the second compressor 412 perform a simultaneous driving. Accordingly, the refrigerant having passed through the first evaporator 431 is secondarily-compressed via the first compressor 411 and the second compressor 412 sequentially, thus to be circulated.

On the other hand, when the driving mode of the refrigerator is a refrigerating chamber driving, the refrigerant switching valve 440 closes the first evaporator 431 but opens the second evaporator 432. And, the first compressor 411 is stopped, and only the second compressor 412 is driven.

The refrigerant passing through the condenser 420 is moved only to the second evaporator 432 thus to be sucked into the second compressor 412. And, the refrigerant compressed in the second compressor 412 and discharged out is moved to the condenser 420 thus to be condensed. These processes are repeatedly performed.

As the refrigerator performs a driving with an independent refrigerating cycle in correspondence to a freezing chamber load or a refrigerating chamber load, unnecessary power consumption is prevented to result in enhanced efficiency.

The controller 200 maintains the current cooling capacity of the first compressor 411 or the second compressor 412 when a change amount of the refrigerating chamber temperature or a change amount of the freezing chamber temperature is more than a reference value at the time of an initial driving. And, the controller 200 increases the cooling capacity of the first compressor 411 or the second compressor 412 when the change amount of the refrigerating chamber temperature or the change amount of the freezing chamber temperature is less than the reference value at the time of an initial driving.

The controller 200 compares a change amount of the refrigerating chamber temperature calculated in the current time period with that in the previous time period, or compares a change amount of the freezing chamber temperature calculated in the current time period with that in the previous time period. If the change amount has been increased as a result of the comparison, the controller performs a load corresponding driving.

If an increase degree of the change amount is greater than a first reference value, the controller 200 increases the cooling capacity of the first compressor 411 or the second compressor 412. If the increase degree of the change amount is smaller than the first reference value but larger than a second reference value, the controller 200 maintains the current cooling capacity of the first compressor 411 or the second compressor 412. If the increase degree of the change amount is smaller than the second reference value, the controller 200 decreases the cooling capacity of the first compressor 411 or the second compressor 412.

Figure 4:
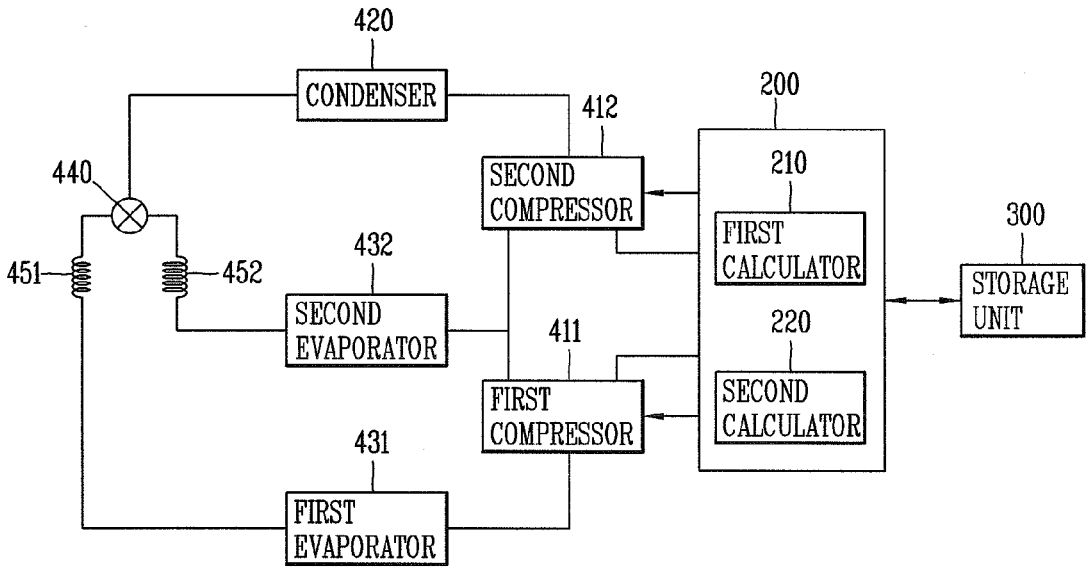
Figure 5:
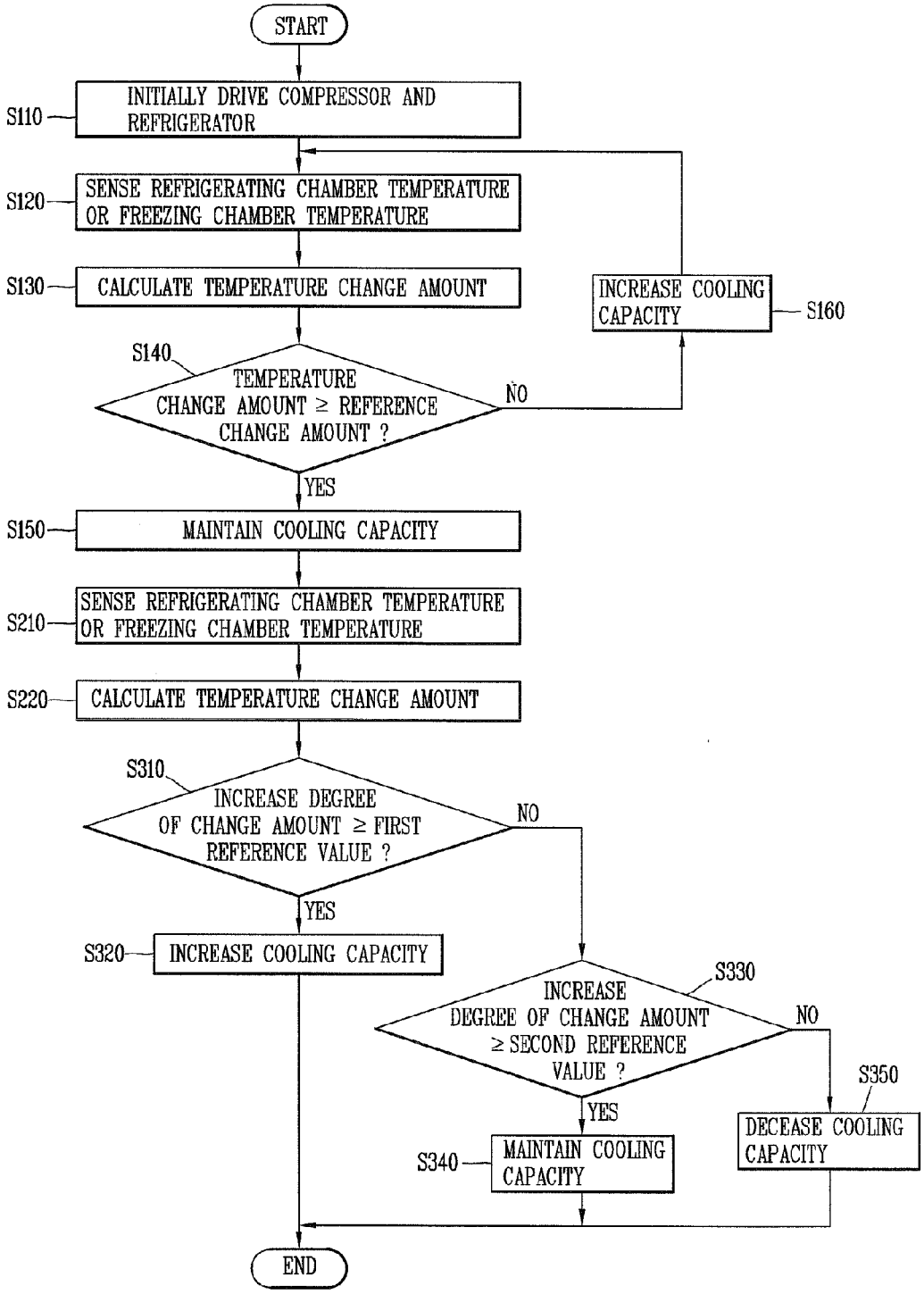
FIG. 5 is a flowchart schematically illustrating a method for controlling a refrigerator according to a first embodiment of the present invention.

Referring to FIG. 5, a method for controlling a refrigerator according a first embodiment of the present invention comprises an initial driving step (S100) of changing a cooling capacity of a compressor based on a change amount of a refrigerating chamber temperature or a change amount of a freezing chamber temperature after an initial driving, a change amount calculation step (S200) of calculating the change amount of the refrigerating chamber temperature or the change amount of the freezing chamber temperature per time period, and a driving execution step (S300) of executing a load corresponding driving based on the change amount of the refrigerating chamber temperature, or the change amount of the freezing chamber temperature calculated per time period. Explanations for configurations of the apparatus will be replaced by FIGS. 2 to 4.

In the initial driving step (S100), when the change amount of the refrigerating chamber temperature or the change amount of the freezing chamber temperature is more than a reference value, a current cooling capacity of the compressor is maintained (S150). When the change amount of the refrigerating chamber temperature or the change amount of the freezing chamber temperature is less than the reference value, the cooling capacity of the compressor is increased (S160).

Once a user applies power to the compressor and the refrigerator to initially drive the compressor and the refrigerator (S110), the refrigerator senses a refrigerating chamber temperature at the time of an initial driving (S120). Then, the refrigerator calculates a change amount of the refrigerating chamber temperature or a change amount of the freezing chamber temperature (S130). Then, the refrigerator compares the calculated change amount of the refrigerating chamber temperature, or the calculated change amount of the refrigerating chamber temperature with each reference value. If the calculated change amount of the cooling or freezing chamber temperature is more than the reference value, the refrigerator maintains a current cooling capacity (S150). If the calculated change amount of the cooling or freezing chamber temperature is less than the reference value, the refrigerator increases the cooling capacity of the compressor (S160).

The driving execution step (S300) includes comparing a change amount of the refrigerating chamber temperature or the freezing chamber temperature calculated in the current time period with that in the previous time period (not shown), and executing a load corresponding driving when the change amount has been increased as a result of the comparison. In the step of executing a load corresponding driving, if an increase degree of the change amount is greater than a first reference value, the cooling capacity of the compressor is increased (S320). If the increase degree of the change amount is smaller than the first reference value but larger than a second reference value, a current cooling capacity of the compressor is maintained (S340). If the increase degree of the change amount is smaller than the second reference value, the cooling capacity of the compressor is decreased (S350).

Figure 6:
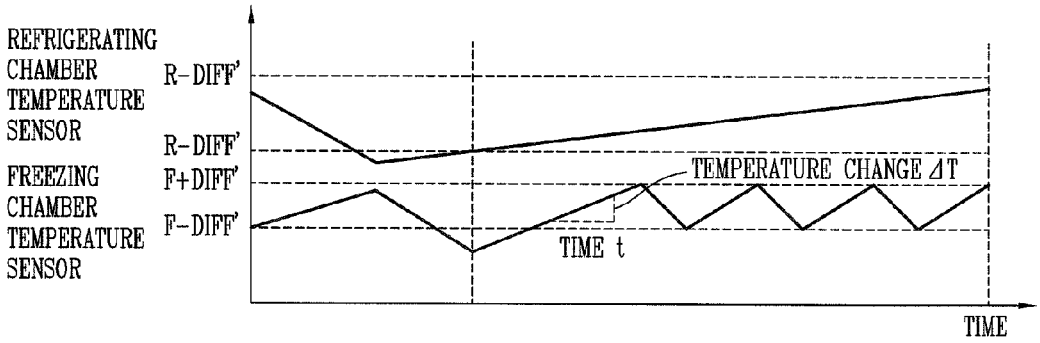
FIG. 6 is a graph illustrating a change of a refrigerating chamber temperature or a change of a freezing chamber temperature with respect to time according to preferred embodiments of the present invention.

Hereinafter, the operation of the refrigerator according to the present invention will be explained with reference to FIG. 6. Once a user initially drives a refrigerating chamber and a freezing chamber with preset temperatures R and F, respectively, the refrigerating chamber performs a general driving within a temperature range of R−DIFF'~R+DIFF'. And, the freezing chamber performs a general driving within a temperature range of R−DIFF'~R+DIFF'. At the time of an initial driving, the refrigerator senses each temperature of the freezing chamber and the refrigerating chamber, and calculates a change amount (gradient) of the temperature per time period. If the change amount is more than a reference value, a current cooling capacity is maintained. On the other hand, if the change amount is less than the reference value, the cooling capacity is increased to allow the current temperatures to reach the preset R and F. The storage unit 300 stores the sensed refrigerating chamber temperature and freezing chamber temperature, and stores the change amount of the refrigerating chamber temperature and the change amount of the freezing chamber temperature. In a general driving mode, the refrigerator senses the refrigerating chamber temperature and the freezing chamber temperature, and calculates each change amount of the refrigerating chamber temperature and the freezing chamber temperature per predetermined time period. Then, the refrigerator compares the calculated change amounts in the current time period with change amounts of the refrigerating chamber temperature and the freezing chamber temperature in the previous time period. Here, the refrigerator may compare the calculated change amounts with change amounts pre-stored in the storage unit.

If the change amount is drastically increased, the refrigerator determines a load change has occurred, thereby performing a load corresponding driving. If an increase degree of the change amount is greater than a first reference value, the refrigerator increases the cooling capacity of the compressor. If the increase degree of the change amount is smaller than the first reference value but larger than a second reference value, the refrigerator maintains the current cooling capacity of the compressor. If the increase degree of the change amount is smaller than the second reference value, the refrigerator decreases the cooling capacity of the compressor.

As aforementioned, in the refrigerator and the method for controlling the same according to the present invention, a change amount of the refrigerating chamber temperature or a change amount of the freezing chamber temperature may be calculated per time period, and a load corresponding driving may be executed based on the calculated change amount or an increased degree of the change amount. This may allow the load corresponding driving to be executed more precisely.

What is claimed is:

1. A refrigerator, comprising:

a refrigerating chamber;

a freezing chamber;

one or more refrigerating chamber temperature sensors configured to sense a temperature of the refrigerating chamber;

one or more freezing chamber temperature sensors configured to sense a temperature of the freezing chamber; and a refrigerating cycle apparatus configured to generate cool air, the refrigerating cycle apparatus comprising;

a first compressor and a second compressor connected to each other, and configured to compress a refrigerant in two stages;

a condenser connected to a discharge side of the second compressor disposed at a downstream side with respect to a flowing direction of the refrigerant;

a first evaporator connected to the condenser, and connected to a suction side of the first compressor disposed at an upstream side with respect to the flowing direction of the refrigerant; and a second evaporator diverged from the condenser together with the first evaporator, and connected between a discharge side of the first compressor and a suction side of the second compressor; and a controller configured to control the refrigerating cycle apparatus to generate cool air, and to control driving of the refrigerator based on an amount of change in the refrigerating chamber temperature or an amount of change in the freezing chamber temperature calculated per predetermined time period, wherein the controller calculates a change in the amount of temperature change by calculating a difference between a first amount of change in the refrigerating chamber temperature in a first time period and a second amount of change in the refrigerating chamber temperature in a second time period, or calculating a difference between a first amount of change in the freezing chamber temperature in a first time period and a second amount of change in the freezing chamber temperature in a second time period, and wherein, if the change in the amount of temperature change is greater than a first reference value, the controller increases the cooling capacity of the compressors, if the change in the amount of temperature change is smaller than the first reference value but larger than a second reference value, the controller maintains the current cooling capacity of the compressors and if the change in the amount of temperature change is smaller than the second reference value, the controller decreases the cooling capacity of the compressors.

2. The refrigerator of claim 1, wherein the refrigerating cycle apparatus further comprises:

a refrigerant switching valve installed at an outlet of the condenser on a divergence point of the first evaporator and the second evaporator, and configured to control the flowing direction of the refrigerant, wherein a discharge side of the first compressor is connected to a suction side of the second compressor so that a refrigerant primarily-compressed at the first compressor can be secondarily-compressed at the second compressor.

3. The refrigerator of claim 2, wherein the first compressor and the second compressor are driven and a refrigerant passing through the condenser moves toward the first evaporator and the second evaporator when a driving mode of the refrigerator is a simultaneous driving mode.

4. The refrigerator of claim 2, wherein a refrigerant passing through the condenser moves toward the first evaporator when a driving mode of the refrigerator is a freezing chamber driving mode, and wherein the refrigerant passed through the first evaporator is compressed twice by the first compressor and the second compressor.

5. The refrigerator of claim 2, wherein the second compressor is driven and a refrigerant passing through the condenser moves toward the second evaporator when a driving mode of the refrigerator is a refrigerating chamber driving mode.

* * * * *